US009490586B1

(12) United States Patent
Horning et al.

(10) Patent No.: US 9,490,586 B1
(45) Date of Patent: Nov. 8, 2016

(54) ELECTRICAL CONNECTOR HAVING A GROUND SHIELD

(71) Applicant: Tyco Electronics Corporation, Berwyn, PA (US)

(72) Inventors: Michael James Horning, Lancaster, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/693,413

(22) Filed: Apr. 22, 2015

(51) Int. Cl.

| | |
|---|---|
| ***H01R 13/6586*** | (2011.01) |
| ***H01R 13/6461*** | (2011.01) |
| ***H01R 13/648*** | (2006.01) |
| ***H01R 13/652*** | (2006.01) |

(52) U.S. Cl.
CPC ..... *H01R 13/6586* (2013.01); *H01R 13/648* (2013.01); *H01R 13/6461* (2013.01); *H01R 13/652* (2013.01)

(58) Field of Classification Search
CPC ..... H01R 13/652; H01R 13/6586
See application file for complete search history.

(56) References Cited

U.S. PATENT DOCUMENTS

| | | | | |
|---|---|---|---|---|
| 7,410,393 | B1 | 8/2008 | Rothermel et al. | |
| 7,566,247 | B2 | 7/2009 | Rothermel et al. | |
| 7,637,767 | B2 | 12/2009 | Davis et al. | |
| 7,862,376 | B2 | 1/2011 | Sypolt et al. | |
| 8,690,604 | B2 * | 4/2014 | Davis | H01R 23/688 439/607.07 |
| 9,142,921 | B2 * | 9/2015 | Wanha | H01R 13/6477 |
| 2015/0303601 | A1 * | 10/2015 | Jeon | H01R 12/716 439/65 |

* cited by examiner

*Primary Examiner* — James Harvey

(57) ABSTRACT

An electrical connector includes a front housing and a plurality of contact modules stacked side by side along a rear side of the front housing. Each contact module comprises a housing frame, multiple signal conductors and ground conductors held in the housing frame, and a ground shield coupled to an outer side of the housing frame. The housing frame is formed by a first shell member abutting a second shell member at an interface. At least one of the shell members defines multiple openings that align with the ground conductors held in the housing frame. The ground shield includes ground tabs that extend through the openings and engage the ground conductors to electrically connect the ground shield and the ground conductors. Broad sides of the signal conductors and the ground conductors are oriented orthogonal to the interface between the first and second shell members.

20 Claims, 7 Drawing Sheets

ELECTRICAL CONNECTOR HAVING A GROUND SHIELD

BACKGROUND OF THE INVENTION

The subject matter herein relates generally to electrical connector systems.

Some electrical connector systems utilize electrical connectors to interconnect two circuit boards, such as a motherboard and daughter card. Signal loss and/or signal degradation is a problem in known electrical systems. For example, crosstalk results from an electromagnetic coupling of the fields surrounding an active conductor (or differential pair of conductors) and an adjacent conductor (or differential pair of conductors). The strength of the electromagnetic coupling generally depends on the separation between the conductors, such that crosstalk may be significant when the electrical connectors are placed in close proximity to each other. Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, with a decrease in size of the electrical connectors. Such an increase in density and/or reduction in size causes further strains on performance.

In order to address performance, some electrical connectors have been developed that utilize shielding between pairs of signal contacts. The shielding is provided in both connectors along the signal lines, such as through ground contacts. Typically, the individual shields are electrically commoned in both circuit boards. However, the shields remain electrically independent between the circuit boards. The signal lines may experience degradation, such as resonance noise, along their lengths through the electrical connectors. The resonance noise is due to standing electromagnetic waves created at the ends of the ground contacts that propagate along the ground contacts and cause the electrical potential of the ground contact to vary along the length, referred to as resonance spikes. The resonance noise can couple to the pairs of signal contacts to degrade the signal performance. The resonance noise and crosstalk between pairs of signal contacts increases as the electrical connectors are used to convey more data at faster data rates and transmitted at higher frequencies. The resonance noise also increases as the length of the ground contacts between grounding locations increases.

A need remains for an electrical connector that reduces resonance noise to improve signal performance of an electrical connector system.

BRIEF DESCRIPTION OF THE INVENTION

In an embodiment, an electrical connector is provided that includes a front housing and a plurality of contact modules. The front housing extends between a front side and a rear side. The front side defines a mating end of the electrical connector that is configured to interface with a mating connector. The contact modules are coupled to the rear side of the front housing and stacked side by side along a lateral stack axis. Each contact module comprises a housing frame, multiple signal conductors and ground conductors held in the housing frame, and a ground shield coupled to an outer side of the housing frame. The housing frame is formed by a first shell member and a second shell member that abut one another at an interface. At least one of the first shell member or the second shell member defines multiple openings extending therethrough. The openings align with and provide access to the ground conductors held in the housing frame. The signal conductors and the ground conductors have broad sides. The broad sides of the signal conductors and the ground conductors are oriented orthogonal to the interface between the first and second shell members. The ground shield includes ground tabs that extend through the openings of one of the first shell member or the second shell member and engage the ground conductors to electrically connect the ground shield and the ground conductors of the contact module.

In another embodiment, an electrical connector is provided that includes a front housing and a plurality of contact modules. The front housing extends between a front side and a rear side. The front side defines a mating end of the electrical connector that is configured to interface with a mating connector. The contact modules are coupled to the rear side of the front housing and are stacked side by side along a lateral stack axis. Each contact module comprises a housing frame, multiple signal conductors and ground conductors held in the housing frame, and a ground shield coupled to an outer side of the housing frame. The housing frame is formed by a first shell member and a second shell member. The housing frame defines signal slots and ground slots. The signal slots and the ground slots are defined partially by the first shell member and partially by the second shell member such that the signal slots and the ground slots extend across a seam at an interface between the first and second shell members. At least one of the first shell member or the second shell member further defines multiple openings extending therethrough. The openings align with the ground slots. The signal conductors are each held in a corresponding signal slot. The ground conductors are each held in a corresponding ground slot. The ground shield includes ground tabs that extend through the openings of one of the first shell member or the second shell member and engage the ground conductors within the ground slots to electrically connect the ground shield and the ground conductors of the respective contact module.

DETAILED DESCRIPTION OF THE INVENTION

Figure 1:
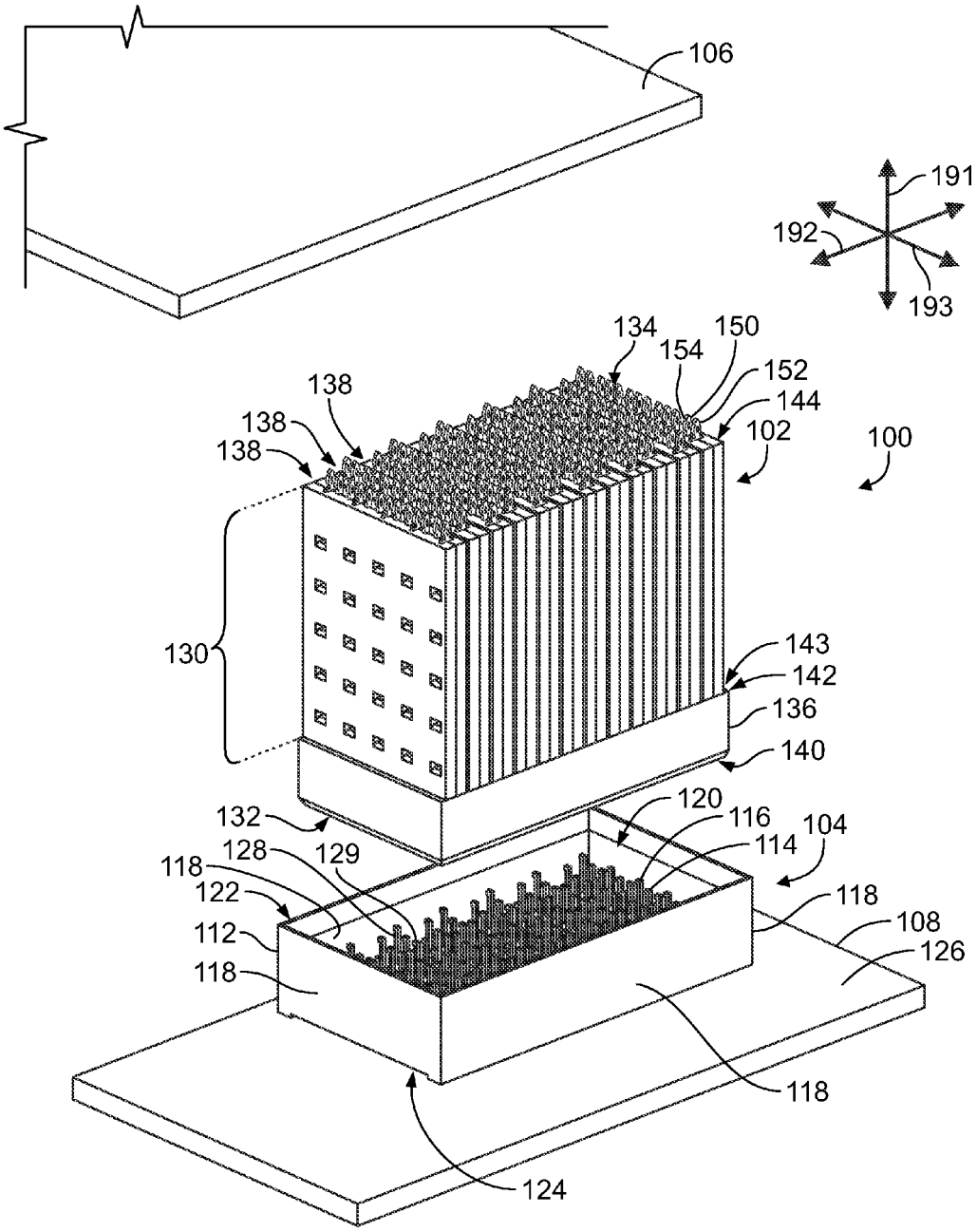
FIG. 1 is a top perspective view of an electrical connector system formed that includes a first electrical connector and a second electrical connector in accordance with an embodiment.

FIG. 1 is a top perspective view of an electrical connector system 100 formed in accordance with an embodiment. The electrical connector system 100 includes a first electrical connector 102 and a second electrical connector 104 that are configured to be directly mated together. In FIG. 1, the first electrical connector 102 and the second electrical connector 104 are shown un-mated, but poised for mating to one another. The first electrical connector 102 and the second electrical connector 104 are configured to be electrically connected to respective first and second circuit boards 106, 108. The first and second electrical connectors 102, 104 are utilized to provide a signal transmission path to electrically connect the circuit boards 106, 108 to one another at a separable mating interface. In FIG. 1, the second electrical connector 104 is mounted to the corresponding second circuit board 108, while the first circuit board 106 is shown spaced apart from the first electrical connector 102 for clarity in order to show details of a mounting end 134 of the first electrical connector 102. In an embodiment, the first and second circuit boards 106, 108 are oriented parallel to one another when the first and second electrical connectors 102, 104 are mated. Alternative relative orientations of the circuit boards 106, 108, such as a perpendicular orientation, are possible in other embodiments. In an alternative embodiment, the first electrical connector 102 and/or the second electrical connector 104 may be terminated to one or more cables rather than being board mounted.

The electrical connector system 100 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity. The elevation axis 191 is referred to herein as a mating axis 191, as the first electrical connector 102 is mated to the second electrical connector 104 by moving the first connector 102 towards the second connector 104 and/or moving the second connector 104 towards the first connector 102 along the mating axis 191.

In an exemplary embodiment, the first electrical connector 102 is a receptacle connector, and is referred to herein as receptacle connector 102. In addition, the second electrical connector 104 is a header or mating connector in an exemplary embodiment, and is referred to herein as a header connector 104. Although one or more embodiments shown and described below describe the receptacle connector 102 as having multiple contact modules 138, it is recognized that in an alternative embodiment, the contact modules 138 and/or other components of the receptacle connector 102 may be part of the header connector 104 instead of, or in addition to, being part of the receptacle connector 102.

The electrical connector system 100 may be disposed on or in an electrical component, such as a server, a computer, a router, or the like. The electrical component may include other electrical devices in addition to the electrical connector system 100 that are located near the electrical connector system 100. Due to space constraints in or on the electrical component, it may be useful to vary the height of the electrical connector system 100 in order to vary the distance between the first and second circuit boards 106, 108. For example, configuring the connector system 100 with a tall height may allow the first circuit board 106 to extend over one or more short electrical devices located on or near the second circuit board 108, to prevent the short electrical device(s) from interfering with the mating between the receptacle and header connectors 102, 104. In another example, configuring the connector system with a short height may allow the first circuit board 106 to extend below one or more overhanging electrical devices, to prevent the overhanging electrical device(s) from interfering with the mating between the receptacle and header connectors 102, 104.

In an embodiment, the receptacle connector 102 is modular in design. The receptacle connector 102 includes a front housing 136 and a plurality of contact modules 138 coupled to the front housing 136. For example, the front housing 136 extends between a front side 140 and a rear side 142. The front side 140 defines a mating end 132 of the receptacle connector 102 that is configured to interface with the header connector 104 or another mating connector. The contact modules 138 are coupled to the rear side 142 of the front housing 136 and are stacked side by side along the lateral axis 192, referred to herein as a lateral stack axis 192. The contact modules 138 may be collectively referred to as a module stack 130. The module stack 130 extends between a front side 143 and a rear side 144. The front side 143 couples to the front housing 136. The rear side 144 defines the mounting end 134 of the receptacle connector 102 that mounts to the circuit board 106. As used herein, relative or spatial terms such as "top," "bottom," "front," "rear," "left," and "right" are only used to distinguish the referenced elements and do not necessarily require particular positions or orientations in the electrical connector system 100 or in the surrounding environment of the electrical connector system 100. The receptacle connector 102 may have any number of contact modules 138 stacked together across the lateral stack axis 192 in the module stack 130, subject to the size and coupling accommodations of the front housing 136.

In an embodiment, a length of the contact modules 138 may be modified in order to adjust the length of the module stack 130 between the front side 143 and the rear side 144, which adjusts the height of the electrical connector system 100 between the circuit boards 106, 108. For example, a first set of contact modules 138 each having a first length may be assembled to the front housing 136 to produce a connector system 100 with a first height. The first set of contact modules 138 may be substituted for a second set of contact modules 138 that each has a second length different from the first length in order to produce a connector system 100 with a second height.

In the illustrated embodiment, the header connector 104 includes a header housing 112 and a plurality of signal contacts 114 and ground contacts 116. The header housing 112 extends between a mating end 122 and a mounting end 124. The header housing 112 includes multiple outer walls 118 that define a socket 120 therebetween. The socket 120 is open at the mating end 122 of the header housing 112 and is configured to receive a portion of the receptacle connector 102 (that includes the mating end 132) therein. The header housing 112 may be box-shaped with four outer walls 118. All or at least some of the outer walls 118 may be beveled at the mating end 122 to provide a lead-in section to guide the receptacle connector 102 into the socket 120 during mating. In the illustrated embodiment, the header housing 112 has a fixed height between the mating end 122 and the mounting end 124. Alternatively, the header connector 104 may have a variable height by stacking multiple housing units together to adjust the height of the header connector 104. The header housing 112 may be formed of at least one dielectric material, such as a plastic or one or more other polymers. The mounting end 124 of the header housing 112 faces, and may also abut, a surface 126 of the second circuit board 108.

The signal contacts 114 and ground contacts 116 of the header connector 104 protrude through a base wall 129 of the header housing 112 into the socket 120. The base wall 129 extends between the outer walls 118 and defines a back wall of the socket 120. The signal contacts 114 and the ground contacts 116 are formed of a conductive material, such as copper, a copper alloy, and/or another metal or metal alloy. In the illustrated embodiment, the signal contacts 114 and the ground contacts 116 each include a pin 128 that extends into the socket 120. Although not clearly shown in FIG. 1, the pins 128 of the ground contacts 116 may be longer than the pins 128 of the signal contacts 114 in order to ensure that a grounding path or circuit between the connectors 102, 104 is established during a mating operation before a signal path or circuit is established. The signal contacts 114 and the ground contacts 116 also each include a terminating segment (not shown) that is configured to engage and electrically connect to a corresponding conductor (also not shown) of the circuit board 108. The conductors may be embodied in electric pads or traces deposited on one or more layers of the circuit board 108, in plated vias, or in other conductive pathways, contacts, and the like.

The receptacle connector 102 includes a plurality of signal conductors 150 and ground conductors 152 that are held in the contact modules 138. At least portions of the signal conductors 150 and the ground conductors 152 may extend into the front housing 136 for engaging with the pins 128 of the signal contacts 114 and ground contacts 116, respectively, of the header connector 104. The signal conductors 150 and the ground conductors 152 may extend parallel to the mating axis 191. The signal and ground conductors 150, 152 extend along lengths that are at least as long as the module stack 130 between the front side 143 and the rear side 144. The ground conductors 152 are configured to provide shielding for the signal conductors 150 along the length of the module stack 130. In the illustrated embodiment, the signal and ground conductors 150, 152 each have a terminating segment 154 that extends beyond the rear side 144 of the module stack 130 (for example, at the mounting end 134) for electrical termination to corresponding conductors (not shown) on the first circuit board 106. The terminating segment 154 may be an eye-of-the-needle pin, which is configured to be through-hole mounted to a corresponding via of the circuit board 106. Alternatively, one or more of the terminating segments 154 may be bent tails configured to be soldered or otherwise surface mounted to conductive pads on the circuit board 106.

The receptacle connector 102 further includes ground shields 156 (shown in FIG. 2) associated with the contact modules 138. The ground shields 156 in an embodiment are each coupled to one of the contact modules 138. The ground shields 156 extend between adjacent contact modules 138. Thus, at least one ground shield 156 extends between the signal and ground conductors 150, 152 of one contact module 138 and the signal and ground conductors 150, 152 of an adjacent contact module 138. The ground shields 156 are electrically conductive. As described further herein, the ground shields 156 are configured to engage and electrically connect to each of the ground conductors 152 in the corresponding contact module 138 to electrically common the ground conductors 152 along a conductive ground circuit defined by the respective ground shield 156. For example, the conductive ground paths formed by the engagement between the ground conductors 152 of the receptacle connector 102 and the ground contacts 116 of the header connector 104 may be electrically commoned at both ends via the circuit boards 106, 108. The ground shields 156 provide multiple grounding locations for the ground conductors 152 to common the ground conductors 152 of each contact module 138 between the circuit boards 106, 108.

It is recognized that electromagnetic interference (EMI), such as resonance noise and crosstalk, between pairs of signal conductors 150 generally increases with increasing data transfer rates, frequencies, and lengths of the ground paths between grounding locations. Such resonance noise and crosstalk may degrade the signal integrity and performance of the electrical connector system 100. In an embodiment, the conductive ground circuits provided by the ground shields 156 reduce the length of the conductive ground paths between grounding locations, thereby improving signal integrity by reducing resonance noise and crosstalk within the connector system 100. For example, shortening the ground paths of the ground conductors 152 may reduce the magnitude of resonance peaks in resonance waves that propagate through the ground conductors 152 within the receptacle connector 102. The length of the ground paths also may affect the resonance frequency of the ground conductors 152. A longer ground path between grounding locations corresponds with a relatively lower resonance frequency, while a shorter ground path length corresponds with a relatively higher resonance frequency. Shortening the length of the ground path via the ground shield 156 may increase the resonance frequency to a level outside of an operating frequency range or band, such that the resonance frequency does not have a detrimental effect on the signal performance of the signal conductors 150. The resonance frequency may be increased to a level at or above 12 GHz, 16 GHz, 20 GHz, or the like.

Figure 2:
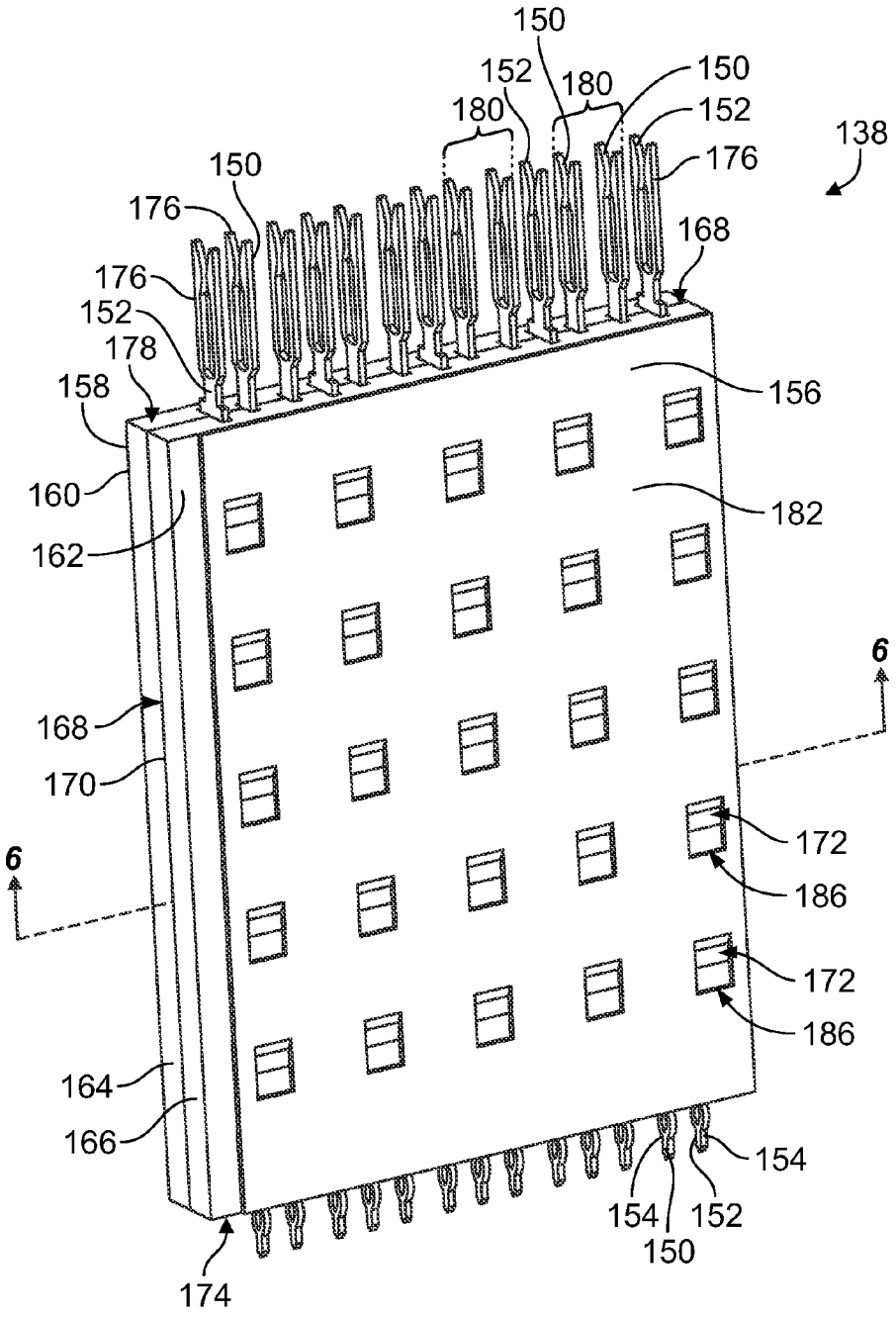
FIG. 2 is a perspective view of a contact module of the first electrical connector according to an embodiment.

FIG. 2 is a perspective view of one of the contact modules 138 of the receptacle connector 102 (shown in FIG. 1) according to an embodiment. The contact module 138 shown in FIG. 2 may be representative of each of the contact modules 138 in the module stack 130 (shown in FIG. 1) of the receptacle connector 102. The contact module 138 in FIG. 2 has an orientation that is generally 180° from the orientation depicted in FIG. 1. For example, the terminating segments 154 of the signal conductors 150 and the ground conductors 152 are disposed along a lower portion of the contact module 138 in FIG. 2, while the terminating segments 154 are disposed along an upper portion of the contact modules 138 shown in FIG. 1.

The contact module 138 includes a housing frame 158. The signal conductors 150 and the ground conductors 152 are held in the housing frame 158. The ground shield 156 is coupled to an outer side of the housing frame 158. For example, the housing frame 158 includes a first outer side 160 and a second outer side 162. In FIG. 2, the ground shield 156 is coupled to the second outer side 162. In an embodiment, the contact module 138 only includes the one ground shield 156 that is disposed along the second outer side 162, such that no ground shield is coupled to the first outer side 160. Alternatively, the single ground shield 156 may be coupled to the first outer side 160 instead of the second outer side 162. In another alternative embodiment, the contact module 138 may include two ground shields 156, with one ground shield 156 coupled to the first outer side 160 and another ground shield 156 coupled to the second outer side 162.

The housing frame 158 is formed by a first shell member 164 and a second shell member 166. The first shell member 164 defines the first outer side 160 of the housing frame 158. The second shell member 166 defines the second outer side 162 of the housing frame 158. The first shell member 164 abuts the second shell member 166 at an interface 168. In an embodiment, the interface 168 is linear and defines a seam 170. The second shell member 166 of the contact module 138 shown in FIG. 2 defines multiple openings 172 that extend therethrough (meaning through the second shell member 166). In an embodiment, the first shell member 164 also defines multiple openings 172 (shown in FIG. 4) that extend through the first shell member 164. The openings 172 align with, and provide access to, the ground conductors 152 held in the housing frame 158.

As shown in FIG. 2, the signal conductors 150 and the ground conductors 152 extend along a length that is longer than a length of the housing frame 158. The terminating segments 154 protrude beyond a rear end 174 of the housing frame 158. The rear end 174 of the housing frame 158 defines a portion of the rear side 144 (shown in FIG. 1) of the module stack 130 (FIG. 1). The signal conductors 150 and the ground conductors 152 also include mating segments 176 at an opposite end of the conductors 150, 152 from the terminating segments 154. The mating segments 176 protrude beyond a front end 178 of the housing frame 158. The front end 178 defines a portion of the front side 143 (shown in FIG. 1) of the module stack 130. The mating segments 176 are configured to engage and electrically connect to the pins 128 (shown in FIG. 1) of the respective signal contacts 114 (FIG. 1) and ground contacts 116 (FIG. 1) of the header connector 104 (FIG. 1). In the illustrated embodiment, the mating segment 176 of each of the signal conductors 150 and the ground conductors 152 is a tuning-fork style interface. In other embodiments, one or more mating segments 176 may be a pin, a socket, or the like, instead of a tuning-fork style interface. The mating segments 176 of the signal and ground conductors 150, 152 are configured to be located axially within the front housing 136 (shown in FIG. 1).

In an embodiment, the signal conductors 150 and the ground conductors 152 are held by the housing frame 158 in a single file line. The single file line of conductors 150, 152 extends along the interface 168 between the first shell member 164 and the second shell member 166. Within the line, the signal conductors 150 may be arranged in a plurality of signal pairs 180 that are configured to carry differential signals. The ground conductors 152 are interleaved between the signal pairs 180 in order to provide shielding between adjacent signal pairs 180. Along the line of conductors 150, 152, the two signal conductors 150 of each signal pair 180 are directly next to one another, and the signal pair 180 is bordered on each side by at least one ground conductor 152. This arrangement is referred to as a repeatable ground-signal-signal-ground (GSSG) sequence or pattern. In the illustrated embodiment, a single ground conductor 152 is positioned or interleaved between adjacent signal pairs 180 of signal conductors 150. However, in other embodiments, adjacent signal pairs 180 may be separated by at least two ground conductors 152.

The ground shield 156 has a planar body 182. The planar body 182 may be formed of a metal plate or the like. The body 182 may abut against the corresponding outer side of the housing frame 158 (for example, the second outer side 162 in the embodiment shown in FIG. 2). Although not visible in FIG. 2, the ground shield 156 includes ground tabs 184 (shown in FIG. 5). The ground tabs 184 extend through the openings 172 of the corresponding shell member (for example, the second shell member 166 in the illustrated embodiment) and engage the ground conductors 152 to electrically connect the ground shield 156 and the ground conductors 152 of the contact module 138. The ground tabs 184 optionally may be stamped and formed out of the planar body 182, such that the ground shield 156 defines windows 186 that define the former locations of the material used to form the ground tabs 184. For example, the windows 186 may be formed by cutting and bending the ground tabs 184 out of the plane of the body 182 of the ground shield 156. Although the ground tabs 184 are not visible in FIG. 2, the windows 186 show the approximate locations of the ground tabs 184 relative to the housing frame 158.

In an embodiment, the ground tabs 184 (shown in FIG. 5) are configured to engage each of the ground conductors 152 within the contact module 138. Therefore, each of the ground conductors 152 is electrically commoned to the other ground conductors 152 via the conductive ground circuit provided by the ground shield 156. Also in an embodiment, the ground tabs 184 are configured to engage the same ground conductor 152 at multiple locations along an axial length of the ground conductor 152 between the mating segment 176 and the terminating segment 154. The redundant grounding at multiple axial locations reduces the ground path length between grounding locations, which may improve signal integrity by reducing resonance noise and crosstalk, reducing the magnitude of resonance peaks in resonance waves that propagate through the ground conductors 152, and/or increasing the resonance frequency of the ground conductors 152 to a value outside of an operating frequency range or band.

Figure 3:
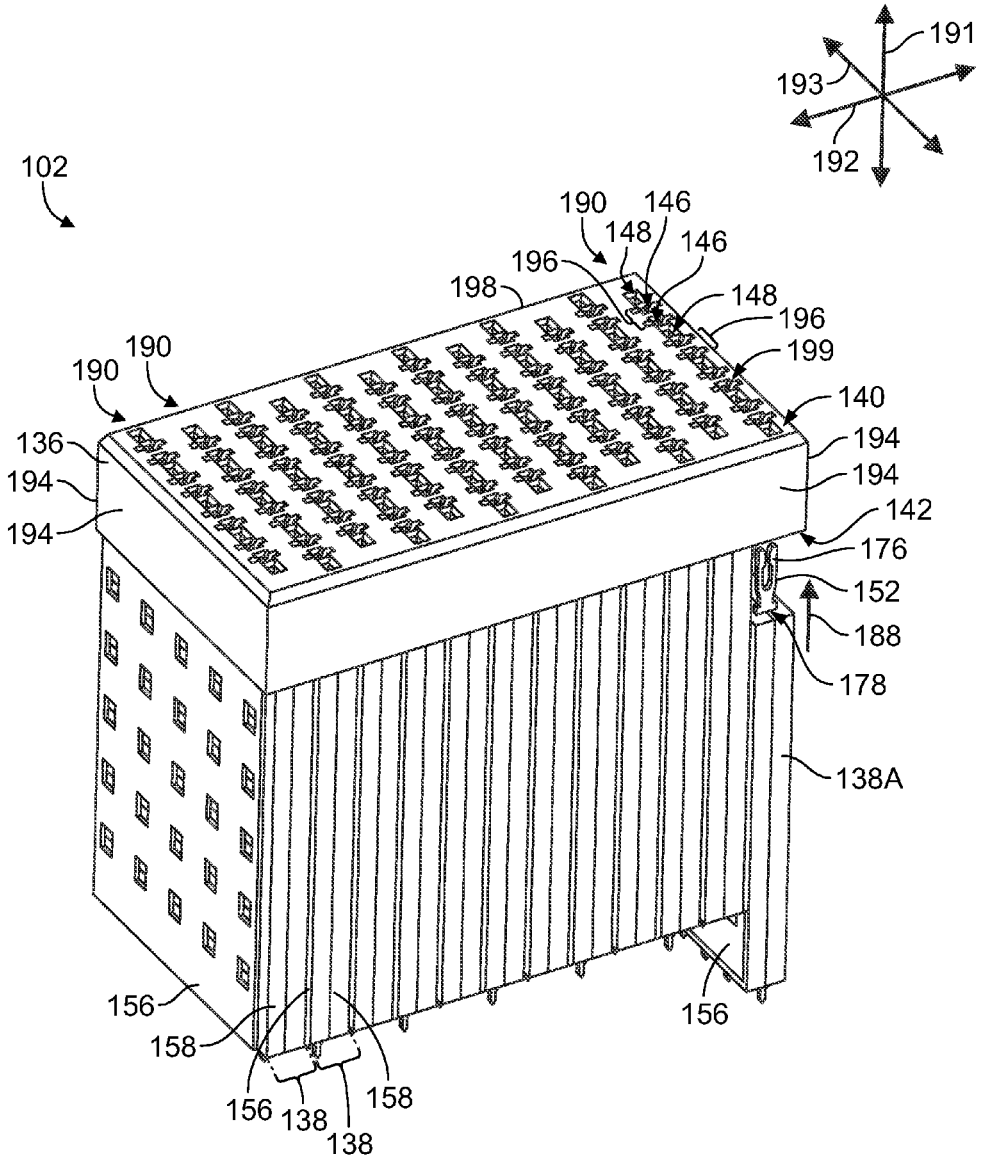
FIG. 3 is a perspective view of the first electrical connector according to an embodiment.

FIG. 3 is a perspective view of the receptacle connector 102 according to an embodiment. The receptacle connector 102 is oriented generally 180° from the orientation of the receptacle connector 102 shown in FIG. 1, such that the front housing 136 is along an upper portion of the connector 102 in FIG. 3. In the illustrated embodiment, all of the contact modules 138 except an end contact module 138A are coupled to the front housing 136. The end contact module 138A is shown poised for coupling to the rear side 142 of the front housing 136.

In FIG. 3, the contact modules 138 are stacked laterally along the lateral stack axis 192. At least one ground shield 156 is disposed or located between the housing frames 158 of each adjacent contact module 138 (although not all of the ground shields 156 are visible in FIG. 3). For example, a single ground shield 156 may be located between the adjacent housing frames 158, where the ground shield 156 is coupled to one of the housing frame 158 via the ground tabs 184 (shown in FIG. 5). The ground shield 156 optionally may abut against the other housing frame 158 that is on the other side of the ground shield 156 (to which the ground shield 156 is not coupled). The end contact module 138A, like the other contact modules 138, is loaded by moving the contact module 138A in a loading direction 188. The loading direction 188 may be parallel to the mating axis 191. The front end 178 of the contact module 138A leads such that the mating segments 176 of the signal conductors 150 (shown in FIG. 2) and the ground conductors 152 that protrude from the front end 178 are received in the front housing 136.

The front housing 136 extends between the front side 140 and the rear side 142. The front housing 136 in the illustrated embodiment has a rectangular or square-shaped cross-sectional area that includes four outer walls 194 extending between the front side 140 and the rear side 142. The front housing 136 is configured to fit within the socket 120 (shown in FIG. 1) of the header connector 104 (FIG. 1). The front housing 136 may be composed of a dielectric material, such as a plastic or one or more other polymers. The front housing 136 defines signal cavities 146 and ground cavities 148 that extend through the front housing 136 between the front side 140 and the rear side 142. The signal cavities 146 receive the mating segments 176 of the signal conductors 150 (shown in FIG. 2) therein, while the ground cavities 148 receive the mating segments 176 of the ground conductors 152 therein. The signal and ground cavities 146, 148 are open at the rear side 142 of the housing 136 in order for the mating segments 176 of the signal and ground conductors 150, 152 to enter the respective cavities 146, 148. The signal and ground cavities 146, 148 are also open at the front side 140 of the housing 136 in order to receive the pins 128 (shown in FIG. 1) of the signal contacts 114 (FIG. 1) and the ground contacts 116 (FIG. 1) of the header connector 104 into the signal cavities 146 and ground cavities 148, respectively, for electrically connecting to the corresponding signal and ground conductors 150, 152.

The signal cavities 146 and the ground cavities 148 are arranged in plural columns 190. Each column 190 corresponds to the signal conductors 150 (shown in FIG. 2) and the ground conductors 152 of one contact module 138. The columns 190 are oriented along the longitudinal axis 193. Twelve columns 190 are shown in FIG. 3, but the front housing 136 may define more or less than twelve columns 190 in other embodiments. In each column 190, the signal cavities 146 and the ground cavities 148 are arranged in a repeating GSSG sequence. In the illustrated embodiment, adjacent pairs 196 of signal cavities 146 in the same column 190 are separated by a single ground cavity 148, although more than one ground cavity 148 may be disposed between pairs 196 of signal cavities 146 in other embodiments.

Optionally, adjacent columns 190 are staggered relative to a reference edge 198 of the front housing 136. The reference edge 198 is an edge of the front housing 136 between the front side 140 and one of the outer walls 194 that is used as a point of reference. For example, the signal cavities 146 and the ground cavities 148 in one column 190 may be offset from the signal cavities 146 and the ground cavities 148 in an adjacent column 190 at respective different distances from the reference edge 198. The cavities 146, 148 of adjacent columns 190 may be offset by a half pitch, a full pitch, or the like. A "pitch" as used herein refers to the distance between the centers of adjacent cavities 146, 148 in the same column 190. Staggering the columns 190 of cavities 146, 148 increases the distance between signal conductors 150 (shown in FIG. 2) of adjacent contact modules 138 that are held in adjacent columns 190. Increasing the distance between the signal conductors 150 of adjacent contact modules 138 may improve signal integrity by reducing crosstalk. Optionally, the signal cavities 146 along the front housing 136 may include cutouts 199 for impedance tuning at the mating interface.

Figure 4:
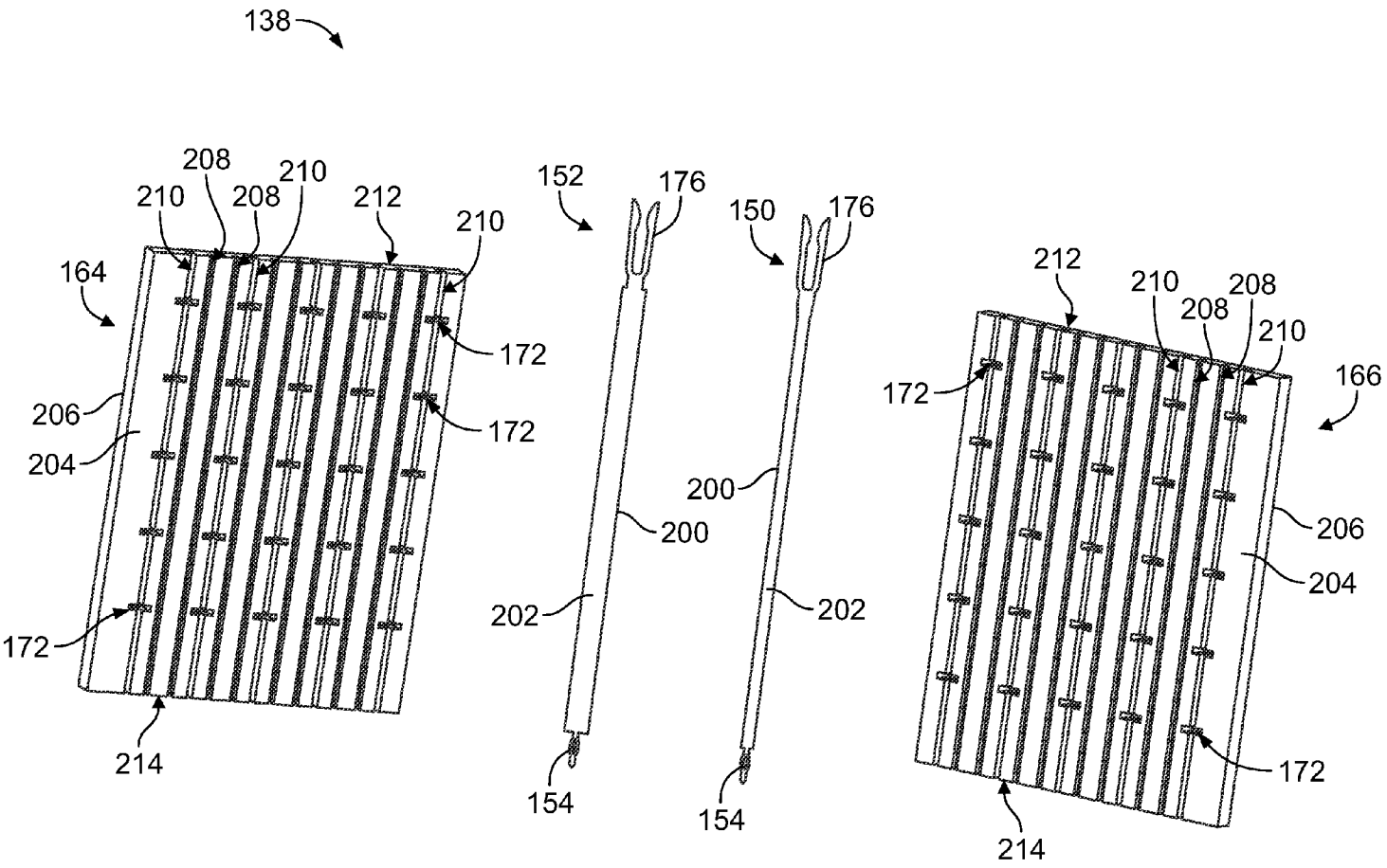
FIG. 4 is an exploded perspective view of one of the contact modules of the first electrical connector according to an embodiment.

FIG. 4 is an exploded perspective view of one of the contact modules 138 of the receptacle connector 102 (shown in FIG. 1) according to an embodiment. The ground shield 156 (shown in FIG. 2) of the contact module 138 is not shown in FIG. 4. Only one representative ground conductor 152 and one representative signal conductor 150 are shown. The signal and ground conductors 150, 152 are electrically conductive and are formed of a conductive material, such as copper, a copper alloy, silver, or another metal or metal alloy. The signal and ground conductors 150, 152 may be stamped and formed from a plate, sheet, or panel of metal. The signal conductors 150 and ground conductors 152 each include the mating segment 176, the terminating segment 154, and a stem 200 that extends longitudinally between the mating segment 176 and the terminating segment 154. The stems 200 of the signal conductors 150 and the ground conductors 152 extend linearly between the mating segments 176 and the terminating segments 154. The stems 200 of the signal conductors 150 and the ground conductors 152 are configured to extend through the housing frame 158 (shown in FIG. 2) of the contact module 138 between the front end 178 (FIG. 2) and the rear end 174 (FIG. 2).

In an embodiment, the stems 200 of the signal and ground conductors 150, 152 have two broad sides 202, although only one broad side 202 of each of the conductors 150, 152 is visible in FIG. 4. The broad sides 202 may be planar such that the stems 200 define conductor planes. The broad sides 202 may be wider than the respective terminating segments 154. The broad sides 202 of the ground conductor 152 are wider than the broad sides 202 of the signal conductor 150 in FIG. 4. The width of the stems 200 of the signal conductors 150 may be selected or restricted based on a desired or mandated impedance of the receptacle connector 102. In alternative embodiments, the width of the stems 200 of the signal conductors 150 may be equal to or greater than the stems 200 of the ground conductors 152.

The first and second shell members 164, 166 may each be composed of a dielectric material, such as a plastic and/or one or more other polymers. The first shell member 164 and the second shell member 166 each include an interior side 204 and an exterior side 206. The interior sides 204 of both shell members 164, 166 are visible in FIG. 4. The interior sides 204 of the shell members 164, 166 face one another when the shell members 164, 166 are assembled together to form the housing frame 158 (shown in FIG. 2). When the shell members 164, 166 are assembled together, the exterior sides 206 of the shell members 164, 166 define the outer sides 160, 162 (shown in FIG. 2) of the housing frame 158. The housing frame 158 defines signal slots 208 and ground slots 210. The signal slots 208 each receive and hold a corresponding signal conductor 150 therein. The ground slots 210 each receive and hold a corresponding ground conductor 152 therein. In an embodiment, the first shell member 164 defines portions of the signal slots 208 and the ground slots 210 along the interior side 204 of the first shell member 164. The second shell member 166 also defines portions of the signal slots 208 and the ground slots 210 along the interior side 204 of the second shell member 166. When the shell members 164, 166 are aligned with one another, the portions of the signal and ground slots 208, 210 defined by the first shell member 164 align with the portions of the signal and ground slots 208, 210 defined by the second shell member 166 to fully define the signal slots 208 and the ground slots 210, as shown in full in FIG. 6.

In an embodiment, the interior side 204 of the first shell member 164 mirrors the interior side 204 of the second shell member 166. In each of the shell members 164, 166, the portions of the signal slots 208 and the ground slots 210 extend parallel to one another. The portions of the signal and ground slots 208, 210 extend the length of the respective shell members 164, 166 between a first end 212 and an opposite second end 214. The first and second ends 212, 214 of the first and second shell members 164, 166 define the front end 178 (shown in FIG. 2) and the rear end 174 (FIG. 2), respectively, of the contact module 138 when assembled. As a result, the stems 200 of the signal conductors 150 may be held parallel to the stems 200 of the ground conductors 152 within the first and second shell members 164, 166 of the housing frame 158 (shown in FIG. 2). The portions of the ground slots 210 in each shell member 164, 166 may be deeper (for example, may extend further into the shell member 164, 166 towards the exterior side 206) than the portions of the signal slots 208, in order to accommodate the different breadths (or widths) of the stems 200 of the ground conductors 152 and the signal conductors 150. In the illustrated embodiment, both the first shell member 164 and the second shell member 166 define the openings 172. The openings 172 extend through the shell members 164, 166 between the interior side 204 and the exterior side 206 of each respective shell member 164, 166. The openings 172 align with the portions of the ground slots 210, such that the openings 172 are fluidly coupled to the ground slots 210 and provide access to the ground slots 210. In an embodiment, multiple openings 172 align with each of the portions of the ground slots 210 to provide multiple access points into the ground slot 210 along the length of the ground slot 210 from exterior of the housing frame 158, as described in more detail with reference to FIG. 5. As shown in FIG. 4, the openings 172 do not align with the portions of the signal slots 208, so no access is provided to the signal slots 208 from exterior of the housing frame 158.

Figure 5:
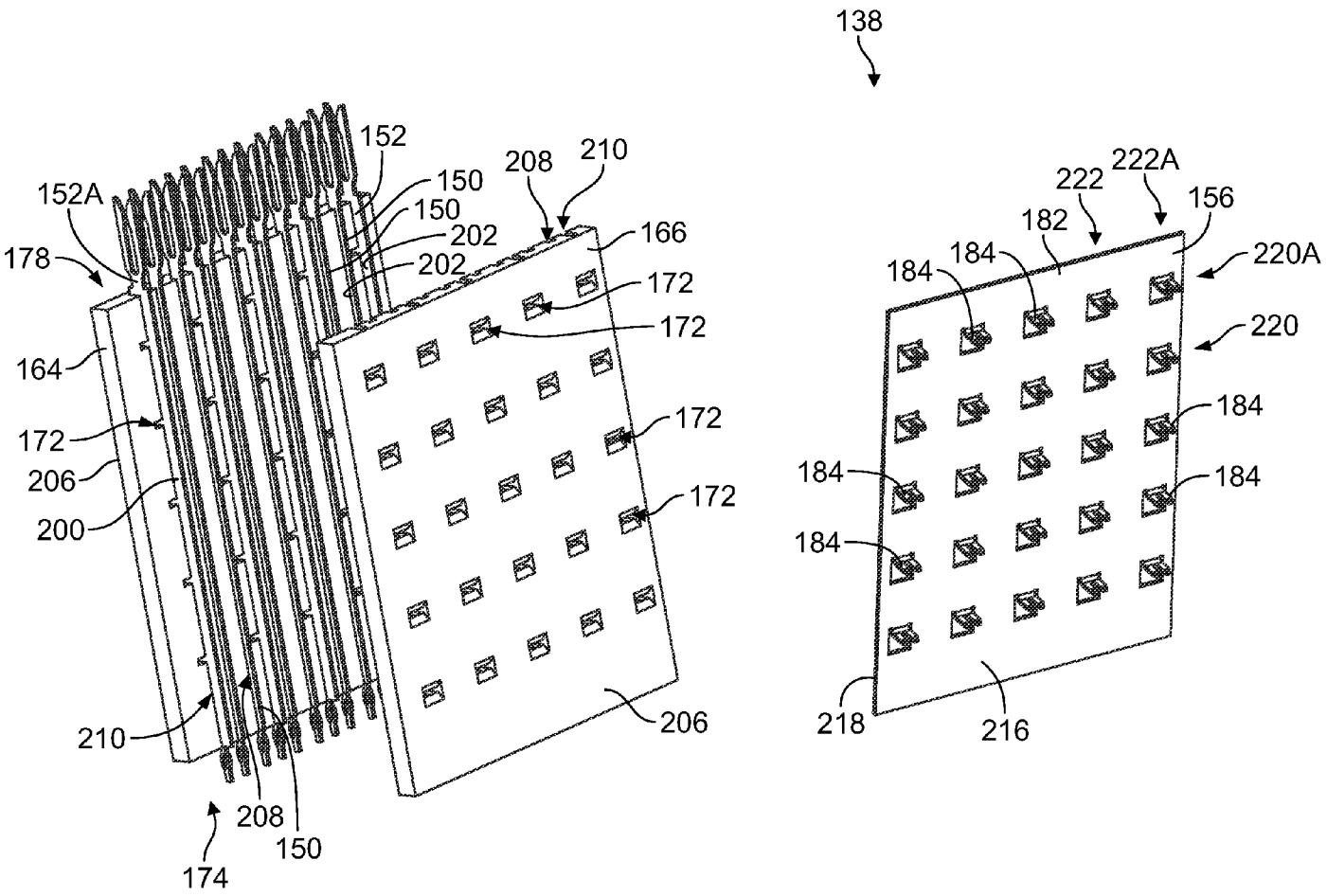
FIG. 5 is an exploded perspective view of one of the contact modules of the first electrical connector shown in a partially assembled state.

FIG. 5 is an exploded perspective view of one of the contact modules 138 of the receptacle connector 102 (shown in FIG. 1) shown in a partially assembled state according to an embodiment. The signal conductors 150 and the ground conductors 152 are shown loaded into the portions of the corresponding signal slots 208 and ground slots 210 of the first shell member 164. The second shell member 166 is poised for coupling to the first shell member 164. The ground shield 156 of the contact module 138 is shown spaced apart from the second shell member 166.

The signal slots 208 each receive and hold a corresponding signal conductor 150 therein. The ground slots 210 each receive and hold a corresponding ground conductor 152 therein. The portions of the signal slots 208 and the ground slots 210 defined by each of the first and second shell members 164, 166 may be sized to accommodate the respective conductors 150, 152 with little or no clearance such that the conductors 150, 152 are retained in the corresponding slots 208, 210 by a friction or interference fit. For example, the portions of the signal slots 208 and the ground slots 210 defined by at least one of the shell members 164, 166 may include deformable crush ribs that are configured to engage at least one of the broad sides 202 of the corresponding conductors 150, 152. Alternatively, or in addition, an adhesive and/or a mechanical feature may be used to hold the signal conductors 150 and the ground conductors 152 in the corresponding signal and ground slots 208, 210, such as to prevent axial movement of the conductors 150, 152 relative to the slots 208, 210.

The planar body 182 of the ground shield 156 includes an inner surface 216 and an opposite outer surface 218. The ground tabs 184 of the ground shield 156 extend from the inner surface 216 out of plane from the body 182. The ground tabs 184 in an embodiment do not extend from the outer surface 218. The ground tabs 184 may be integral to the body 182, or, alternatively, may be coupled to the body 182. In the illustrated embodiment, the inner surface 216 of the ground shield 156 is configured to be placed along the exterior side 206 of the second shell member 166. The ground tabs 184 align with and extend through the openings 172 of the second shell member 166 to access and engage the ground conductors 152 that are loaded within the ground slots 210. In some other contact modules 138 (shown in FIGS. 1 and 3, for example), the inner surface 216 of the ground shield 156 may be placed along the exterior side 206 of the first shell member 164, such that the ground tabs 184 extend through the openings 172 of the first shell member 164 to engage the ground conductors 152 within the ground slots 210. The inner surface 216 may abut against the exterior side 206 of the respective first shell member 164 or second shell member 166.

The ground shield 156 may be composed of a conductive material, such as copper, a copper alloy, silver, or another metal or metal alloy. The ground shield 156 optionally may be stamped and formed from a plate, panel, or sheet of metal. For example, the ground tabs 184 may be formed by stamping the body 182 and then bending the ground tabs 184 out of the plane of the body 182. Alternatively, the ground shield 156 may include a dielectric material that is plated with a metal material to provide electrically conductive properties. The conductive properties of the ground shield 156 allows the ground shield 156 to electrically connect to the ground conductors 152 engaged by the ground tabs 184 and to provide a ground circuit that electrically commons the ground conductors 152 of the contact module 138.

In an embodiment, the ground tabs 184 of the ground shield 156 are configured to engage each ground conductor 152 of the contact module 138 and/or to engage each ground conductor 152 at multiple axial locations along a length of that corresponding ground conductor 152. As shown in FIG. 5, the ground tabs 184 of the ground shield 156 are arranged in an array of rows 220 and columns 222. The ground tabs 184 along one of the columns 222 engage a same corresponding one of the ground conductors 152 at respective different axial locations along a length of the contact module 138 between the front end 178 of the contact module 138 and the rear end 174. For example, each tab 184 in the column 222A is configured to engage the stem 200 of the ground conductor 152A at a respective different axial location along the length of the stem 200. In the illustrated embodiment, each column 222 includes five ground tabs 184 that engage the same ground conductor 152 at five different axial locations along the length of the ground conductor 152. The ground shield 156 thus provides multiple grounding locations along the length of the stem 200 (in addition to grounding that occurs at the circuit board 106 (shown in FIG. 1)). The redundant grounding at multiple axial locations may improve signal integrity by reducing resonance noise and crosstalk, reducing the magnitude of resonance peaks in resonance waves that propagate through the ground conductors 152, and/or increasing the resonance frequency of the ground conductors 152 to a value outside of an operating frequency range or band.

In addition, the ground tabs 184 along one of the rows 220 are configured to engage different ground conductors 152 of the contact module 138 at the same (or approximately the same) axial location along the length of the contact module 138 between the front end 178 and the rear end 174. For example, the tabs 184 in the row 220A are configured to extend through corresponding openings 172 in the second shell member 166 that are most proximate to the front end 178 of the contact module 138. Each of the tabs 184 in the row 220A engages a respective different ground conductor 152 at an axial location that is most proximate to the front end 178 (compared to other contact locations between other ground tabs 184 of the ground shield 156 and the ground conductors 152). In the illustrated embodiment, each row 220 includes five ground tabs 184, and each ground tab 184 is configured to engage a respective different one of the five ground conductors 152 held in the contact module 138. The ground shield 156 creates a conductive ground circuit, defined by the body 182 and the ground tabs 184, that electrically commons the ground conductors 152 to one another. It is recognized that the rows 220 and/or columns 222 of the ground shield 156 may include other than five ground tabs 184 in other embodiments.

Figure 6:
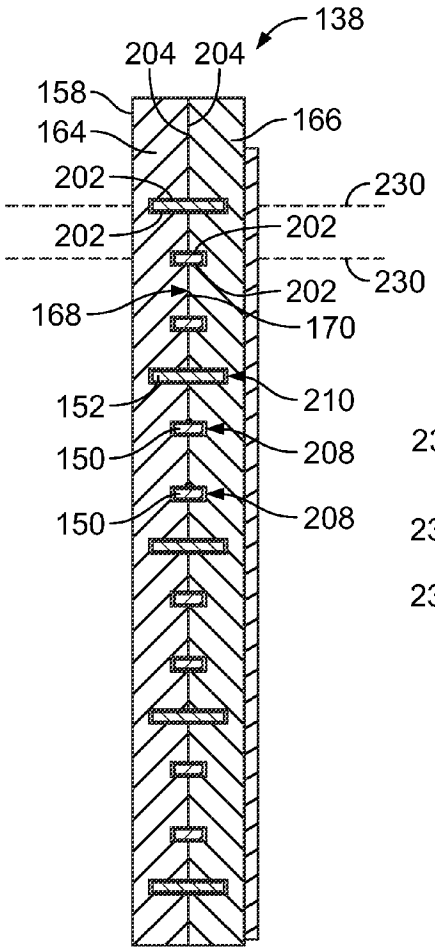
FIG. 6 is a bottom cross-sectional view of the contact module shown in FIG. 2.

FIG. 6 is a bottom cross-sectional view of the contact module 138 shown in FIG. 2 taken along line 6-6 of FIG. 2. The first shell member 164 is coupled to the second shell member 166 to form the housing frame 158 as well as to fully define the signal slots 208 and the ground slots 210. Since the portions of the signal slots 208 and the ground slots 210 are defined along the interior sides 204 of the first and second shell members 164, 166, the signal slots 208 and the ground slots 210 extend across the seam 170 defined along the interface 168 between the shell members 164, 166. The signal and ground slots 208, 210 in the illustrated embodiment are oriented orthogonal to the seam 170. The ground slots 210 are wider in a lateral direction than the signal slots 208 to accommodate the ground conductors 152 which are broader than the signal conductors 150 in the illustrated embodiment. The signal conductors 150 and the ground conductors 152 are shown within the corresponding signal slots 208 and ground slots 210. The signal conductors 150 and the ground conductors 152 are arranged in a single file line that extends along the interface 168 between the shell members 164, 166. The signal conductors 150 and the ground conductors 152 may define conductor planes 230 due to the conductors 150, 152 having planar broad sides 202. In an embodiment, the conductor planes 230 of the signal conductors 150 and the conductor planes 230 of the ground conductors 152 are oriented orthogonal to the seam 170 at the interface 168. The conductor planes 230 of the signal conductors 150 and/or of the ground conductors 152 may be oriented at other angles, such as oblique angles, relative to the seam 170 in other embodiments.

Figure 8:
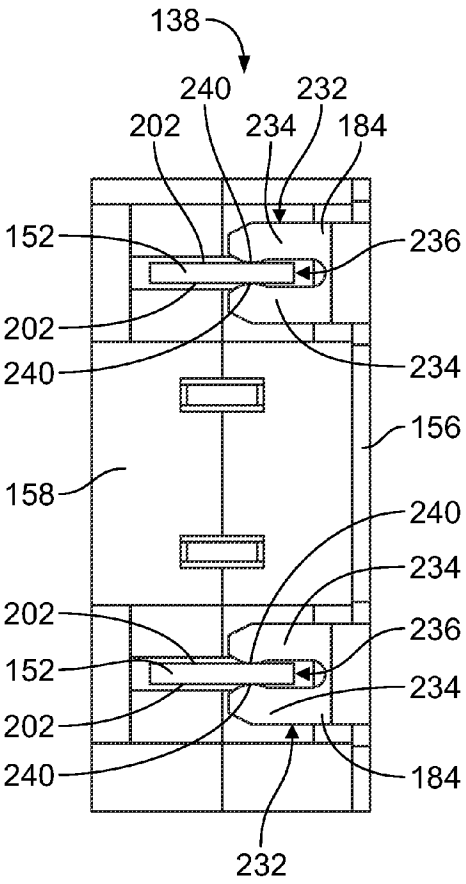
FIG. 8 is a close-up cross-sectional view of a portion of one of the contact modules of the first electrical connector.
Figure 7:
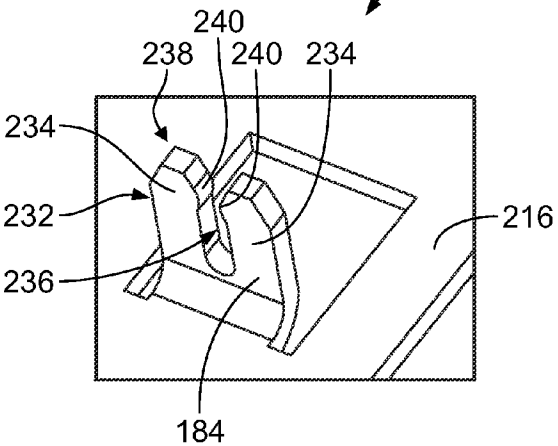
FIG. 7 is a close-up perspective view of a portion of a ground shield of one of the contact modules of the first electrical connector according to an embodiment.

FIG. 7 is a close-up perspective view of a portion of the ground shield 156 of one of the contact modules 138 (shown in FIG. 1) of the receptacle connector 102 (FIG. 1) according to an embodiment. FIG. 8 is a close-up cross-sectional view of a portion of one of the contact modules 138. The depicted portion of the ground shield 156 in FIG. 7 includes one ground tab 184 extending from the inner surface 216 of the ground shield 156. The ground tab 184 includes a mating segment 232 that is configured to engage the corresponding ground conductor 152 and retain engagement with the ground conductor 152. In an embodiment, the mating segment 232 of the ground tab 184 (as well as the other ground tabs 184 shown in FIG. 5) is an insulation displacement contact (IDC) type mating segment. For example, the mating segment 232 includes two blades 234 that define a slot 236 between the blades 234. The blades 234 extend to a distal end 238 of the ground tab 184, such that the slot 236 is open at the distal end 238. The blades 234 each may include an interference feature 240 that extends into the slot 236 towards the other blade 234.

As shown in FIG. 8, the blades 234 extend along different broad sides 202 of the corresponding ground conductor 152 as the ground shield 156 is mounted or coupled to the housing frame 158 such that the ground conductor 152 is received in the slot 236. The interference features 240 of the blades 234 are configured to engage the opposing broad sides 202 of the corresponding ground conductor 152 to retain the engagement between the ground tab 184 and the ground conductor 152. In other embodiments, the mating segment 232 of the ground tabs 184 may be a single deflectable tab, or the like, instead of an IDC type mating segment.

Figure 9:
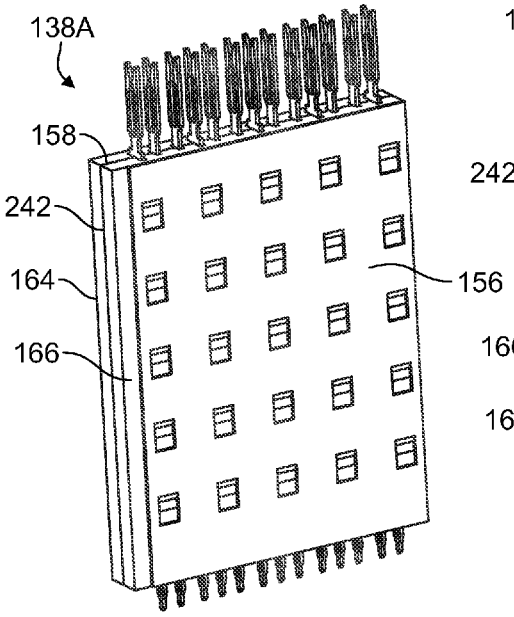
FIG. 9 is a perspective view of one contact module of the first electrical connector.
Figure 10:
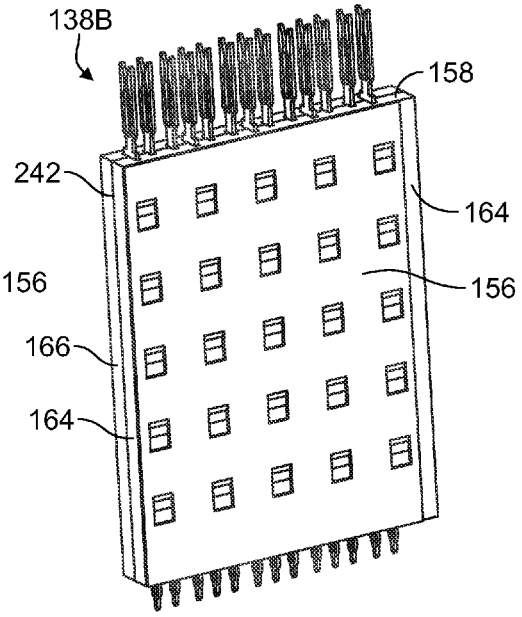
FIG. 10 is a perspective view of another contact module of the first electrical connector.
Figure 11:
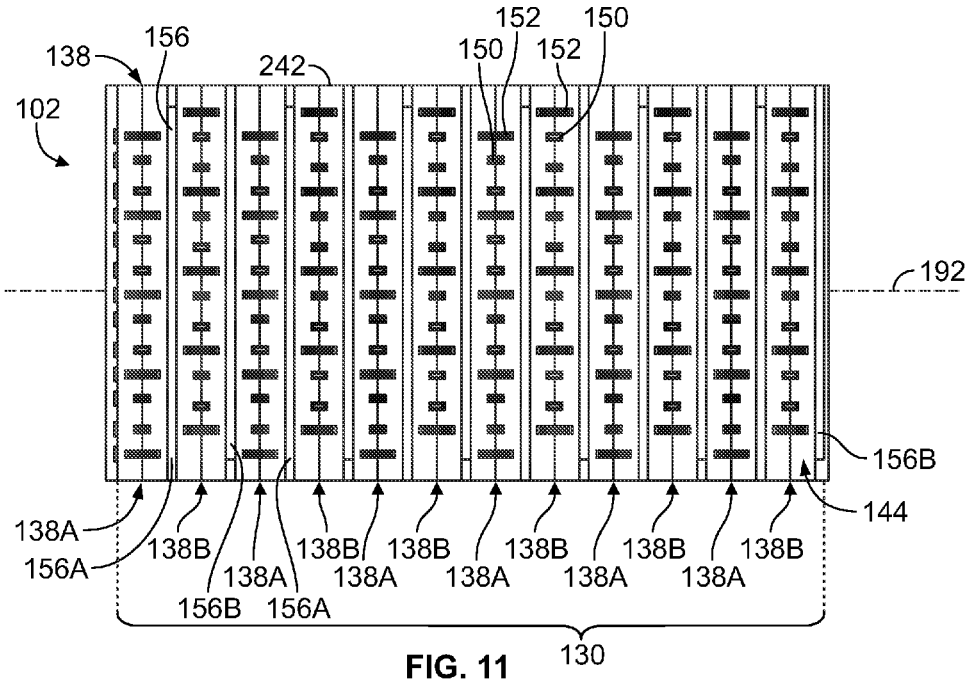
FIG. 11 is a bottom view of a module stack of the first electrical connector according to an embodiment.

FIG. 9 is a perspective view of one contact module 138A of the receptacle connector 102 (shown in FIG. 1), and FIG. 10 is a perspective view of another contact module 138B of the receptacle connector 102 according to an embodiment. FIG. 11 is a bottom view showing the rear side 144 of the module stack 130 of the receptacle connector 102 according to an embodiment. The contact module 138A is referred to as a first contact module 138A for identification purposes only, while the contact module 138B is referred to as a second contact module 138B also for identification purposes. In the first contact module 138A, the ground shield 156 is coupled to the second shell member 166 of the housing frame 158. In the second contact module 138B, the ground shield 156 is coupled to the first shell member 164 of the housing frame 158. In the illustrated embodiment, the only difference between the first and second contact modules 138A, 138B is the placement of the respective ground shield 156 on different sides of the respective housing frames 158. In alternative embodiments, however, the first contact modules 138A may be formed using a different housing frame and/or a different ground shield than the respective housing frame and/or ground shield used to form the second contact modules 138B.

As shown in FIG. 11, the module stack 130 of contact modules 138 may include a plurality of first contact modules 138A alternating with a plurality of second contact modules 138B along the lateral stack axis 192. As such, a first contact module 138A within an interior of the stack 130 has a second contact module 138B on both sides as adjacent contact modules 138. By alternating the first and second contact modules 138A, 138B, a single ground shield 156, either a ground shield 156A of the first contact module 138A or a ground shield 156B of the second contact module 138B, is disposed between each pair of adjacent contact modules 138 in the module stack 130.

Optionally, the signal and ground conductors 150, 152 of the first contact modules 138A may be staggered from the signal and ground conductors 150, 152 of the second contact modules 138B. For example, the signal and ground conductors 150, 152 of each first contact module 138A are offset from a reference side wall 242 of the module stack 130 at respective distances that are different than distances of the signal and ground conductors 150, 152 of each adjacent second contact module 138B, in order to increase the distance between signal conductors 150 of adjacent contact modules 138. The reference side wall 242 is one of the walls of the module stack 130 that extends between the front side 143 (shown in FIG. 1) of the module stack 130 and the rear side 144 of the module stack 130 and is used as a point of reference. The reference side wall 242 is partially defined by each of the contact modules 138, as identified on the contact modules 138A, 138B in FIGS. 9 and 10, respectively.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a front housing extending between a front side and a rear side, the front side defining a mating end of the electrical connector that is configured to interface with a mating connector; and a plurality of contact modules coupled to the rear side of the front housing and stacked side by side along a lateral stack axis, each contact module comprising a housing frame, multiple signal conductors and ground conductors held in the housing frame, and a ground shield coupled to an outer side of the housing frame, the housing frame being formed by a first shell member and a second shell member that abut one another at an interface, the signal conductors and the ground conductors of each contact module arranged in a single file line along the interface between the first and second shell members, at least one of the first shell member or the second shell members defining multiple openings extending therethrough, the openings aligning with and providing access to the ground conductors held in the housing frame, the signal conductors and the ground conductors having broad sides, the broad sides of the signal conductors and the ground conductors being oriented orthogonal to the interface between the first and second shell members, the ground shield including ground tabs that extend through the openings of one of the first shell member or the second shell member and engage the ground conductors to electrically connect the ground shield and the ground conductors of the contact module.

2. The electrical connector of claim 1, wherein the housing frame defines signal slots and ground slots, the signal slots each receiving and holding a corresponding signal conductor therein, the ground slots each receiving and holding a corresponding ground conductor therein, the signal slots and the ground slots each being defined partially by the first shell member and partially by the second shell member such that the signal slots and the ground slots extend across a seam at the interface between the first and second shell members.

3. The electrical connector of claim 1, wherein the signal conductors and the ground conductors each includes a mating segment, a terminating segment, and a stem that extends between the mating segment and the terminating segment, the stems of the signal conductors and the ground conductors of each contact module extending linearly through the housing frame between a front end of the contact module and a rear end of the contact module.

4. The electrical connector of claim 1, wherein the ground tabs of the ground shield are arranged in an array of rows and columns, the ground tabs along one of the columns engaging a same one of the ground conductors at respective different axial locations along a length of the respective contact module.

5. The electrical connector of claim 1, wherein the ground tabs of the ground shield are arranged in an array of rows and columns, the ground tabs along one of the rows engaging respective different ground conductors at a same axial location along a length of the respective contact module.

6. The electrical connector of claim 1, wherein the ground tabs of the ground shield each include an insulation displacement contact type mating segment.

7. The electrical connector of claim 1, wherein the ground tabs of the ground shield each include two blades that define a slot therebetween, the slot receiving a corresponding ground conductor therein and the blades each engaging one of the broad sides of the corresponding ground conductor.

8. The electrical connector of claim 1, wherein the contact modules form a module stack, the signal conductors and the ground conductors of adjacent contact modules being staggered such that the signal conductors and the ground conductors of a first contact module are offset from a reference side wall of the module stack at respective distances that are different than distances of the signal conductors and the ground conductors of a second contact module adjacent to the first contact module.

9. The electrical connector of claim 1, wherein the single file line including multiple pairs of the signal conductors with at least one ground conductor interleaved between adjacent pairs of the signal conductors.

10. The electrical connector of claim 1, wherein the front housing defines signal cavities and ground cavities that extend through the front housing between the front side and the rear side, the signal cavities receiving mating segments of the signal conductors therein, the ground cavities receiving mating segments of the ground conductors therein.

11. The electrical connector of claim 1, wherein the contact modules each have only one ground shield, the contact modules being stacked along the lateral stack axis such that a single ground shield is disposed between the housing frames of adjacent contact modules.

12. An electrical connector comprising:

a front housing extending between a front side and a rear side, the front side defining a mating end of the electrical connector that is configured to interface with a mating connector; and a plurality of contact modules coupled to the rear side of the front housing and stacked side by side along a lateral stack axis, each contact module comprising a housing frame, multiple signal conductors and ground conductors held in the housing frame, and a ground shield coupled to an outer side of the housing frame, the housing frame being formed by a first shell member and a second shell member that abut one another at an interface, at least one of the first shell member or the second shell members defining multiple openings extending therethrough, the openings aligning with and providing access to the ground conductors held in the housing frame, the signal conductors and the ground conductors having broad sides, the broad sides of the signal conductors and the ground conductors being oriented orthogonal to the interface between the first and second shell members, the ground shield including ground tabs that extend through the openings of one of the first shell member or the second shell member and engage the ground conductors to electrically connect the ground shield and the ground conductors of the contact module, wherein the ground tabs of the ground shield engage each ground conductor of the contact module at multiple axial locations along a length of the corresponding ground conductor.

13. The electrical connector of claim 1, wherein each of the signal conductors extends across the interface and is held by both the first and second shell members of the corresponding contact module.

14. An electrical connector comprising:

a front housing extending between a front side and a rear side, the front side defining a mating end of the electrical connector that is configured to interface with a mating connector; and a plurality of contact modules coupled to the rear side of the front housing and stacked side by side along a lateral stack axis, each contact module comprising:

a housing frame formed by a first shell member and a second shell member, the housing frame defining signal slots and ground slots, the signal slots and the ground slots being defined partially by the first shell member and partially by the second shell member such that the signal slots and the ground slots extend across a seam at an interface between the first and second shell members, at least one of the first shell member or the second shell member further defining multiple openings extending therethrough, the openings aligning with the ground slots, multiple signal conductors and ground conductors held in the housing frame, the signal conductors each held in a corresponding signal slot, the ground conductors each held in a corresponding ground slot, and a ground shield coupled to an outer side of the housing frame, the ground shield including ground tabs that extend through the openings of one of the first shell member or the second shell member and engage the ground conductors within the ground slots to electrically connect the ground shield and the ground conductors of the respective contact module.

15. The electrical connector of claim 14, wherein the signal conductors and the ground conductors have planar broad sides and define conductor planes, the signal conductors and the ground conductors being held by the housing frame such that the conductor planes are oriented orthogonal to the seam at the interface between the first and second shell members.

16. The electrical connector of claim 14, wherein the ground tabs of the ground shield are arranged in an array of rows and columns, the ground tabs along one of the columns engaging a same one of the ground conductors at respective different axial locations along a length of the respective contact module.

17. The electrical connector of claim 14, wherein the ground tabs of the ground shield are arranged in an array of rows and columns, the ground tabs along one of the rows engaging respective different ground conductors at a same axial location along a length of the respective contact module.

18. The electrical connector of claim 14, wherein the ground tabs of the ground shield each include two blades that define a slot therebetween, the slot receives a corresponding ground conductor therein and the blades engage opposing broad sides of the corresponding ground conductor.

19. The electrical connector of claim 14, wherein the contact modules each have only one ground shield, the contact modules being stacked along the lateral stack axis such that a single ground shield is disposed between the housing frames of adjacent contact modules.

20. The electrical connector of claim 14, wherein the signal conductors and the ground conductors of each contact module are arranged in a single file line along the interface between the first shell member and the second shell member, the single file line including multiple pairs of the signal conductors with at least one ground conductor interleaved between adjacent pairs of the signal conductors.

* * * * *